US005617194A

United States Patent [19]

Morishita et al.

[11] Patent Number: 5,617,194

[45] Date of Patent: Apr. 1, 1997

[54] CLEANING UNIT INCLUDING A CLEANING ROLLER AND A SEPARATOR PLATE WHICH SEPARATES A CLEANING CHAMBER FROM A TONER STORAGE AND WHICH COMES WITHIN A PREDETERMINED SPACING FROM THE CLEANING ROLLER

[75] Inventors: Hiroki Morishita; Susumu Taniguchi; Shinichi Kotera, all of Osaka, Japan

[73] Assignee: Mita Industrial, Co., Ltd., Osaka, Japan

[21] Appl. No.: 398,784

[22] Filed: Mar. 6, 1995

[30] Foreign Application Priority Data

Mar. 15, 1994 [JP] Japan ..... 6-044220

[51] Int. Cl.[6] ..... G03G 21/00

[52] U.S. Cl. ..... 399/349; 399/350; 399/357; 399/358

[58] Field of Search ..... 355/296, 298, 355/299, 301, 302, 305, 297; 15/256.5, 256.51, 256.52; 118/652; 430/125

[56] References Cited

U.S. PATENT DOCUMENTS

| | | | |
|---|---|---|---|
| 3,838,472 | 10/1974 | Oriel | 15/256.51 |
| 4,739,370 | 4/1988 | Yoshida et al. | 118/652 X |
| 4,975,748 | 12/1990 | Koinuma et al. | 355/305 |
| 5,138,394 | 8/1992 | Watanabe et al. | 355/298 |
| 5,249,025 | 9/1993 | Nakazawa et al. | 355/305 X |

FOREIGN PATENT DOCUMENTS

| | | | |
|---|---|---|---|
| 56-77880 | 6/1981 | Japan | 355/298 |
| 58-190974 | 11/1983 | Japan | 355/296 |
| 60-107076 | 6/1985 | Japan | 355/298 |
| 60-202462 | 10/1985 | Japan | 355/298 |
| 3-158886 | 7/1991 | Japan | 355/298 |
| 4-220680 | 8/1992 | Japan | 355/298 |

*Primary Examiner*—Shuk Yin Lee

*Attorney, Agent, or Firm*—Beveridge, Degrandi, Weilacher & Young, LLP

[57] ABSTRACT

There is provided a cleaning unit for removing residual toner present on the periphery of a photoconductive drum after toner image transfer, which includes: a main blade for scraping the toner from the surface of the photoconductive drum; and a cleaning roller disposed below the main blade and abutting against the periphery of the photoconductive drum. The inner space of the cleaning housing is divided into a cleaning chamber and a toner storage by a separator plate. A spacing between the lower end of the separator plate and the periphery of the cleaning roller is adjusted to preferably 1 mm to 2 mm, more preferably 1.3 mm to 1.5 mm. By thus adjusting the spacing, the toner is compressed when passing through the spacing and, hence, the toner transportation pressure is increased.

3 Claims, 4 Drawing Sheets

CLEANING UNIT INCLUDING A CLEANING ROLLER AND A SEPARATOR PLATE WHICH SEPARATES A CLEANING CHAMBER FROM A TONER STORAGE AND WHICH COMES WITHIN A PREDETERMINED SPACING FROM THE CLEANING ROLLER

CROSS REFERENCE TO RELATED APPLICATION

This application claims priority benefits of Japanese Patent Application No.6-44220 (1994) under 35 USC § 119, the disclosure of said Japanese Patent Application being incorporated herein by reference.

BACKGROUND OF THE INVENTION

1. Field of the Invention

The present invention relates to a cleaning unit for removing toner from the surface of a photoconductive drum after image transfer to clean the photoconductive drum.

2. Description of Related Arts

Conventional cleaning units of this type include a cleaning chamber where toner is scraped away from the surface of a photoconductive drum, and a toner storage for storing therein the scraped toner, both of which are accommodated in a single unit thereof.

In the cleaning unit, typically, the toner adhering on the periphery of the photoconductive drum is scraped away by means of a blade slidably contacting the photoconductive drum, and transported to the toner storage by means of a rotative transportation roller and transportation paddle.

However, the toner, paper dust and the like adhering on the surface of the photoconductive drum cannot assuredly be scraped away with the aforesaid blade alone. Therefore, the conventional cleaning unit cannot ensure a sufficient cleaning performance and, hence, cannot provide a desirable image-transferring capability.

To this end, there has been proposed a cleaning unit having a cleaning roller for assisting a blade to scrape away toner as shown in FIG. 3. Referring to FIG. 3, the cleaning unit includes a cleaning chamber 901 where toner is scraped away from the surface of a photoconductive drum 904 and a toner storage 902 for storing therein the scraped toner, which are separated by a separator plate 903.

In this cleaning unit, a blade 905 slidably contacting the periphery of the photoconductive drum 904 is adapted to scrape the toner away from the periphery of the photoconductive drum 904 into the cleaning chamber 901. A cleaning roller 906 disposed below the blade 905 slidably contacts the periphery of the photoconductive drum 904 and rotates in association with the rotation of the photoconductive drum 904. The cleaning roller 906 serves to displace, on the periphery of the photoconductive drum 904, the toner and paper dust adhering thereon, so that the toner and paper dust can be easily scraped by the blade 905.

The toner scraped away by the blade 905 in the cleaning chamber 901 is transported to the toner storage 902 through a toner transportation port 908 disposed below the separator plate 903 by means of a rotative transportation paddle 907 with an L-shaped cross section disposed beside the cleaning roller 906.

However, the cleaning chamber 901 accommodating the cleaning roller 906 and transportation paddle 907 occupies a relatively large space in the cleaning unit, thereby reducing the relative volume of the toner storage 902. This means that the toner storage capacity relative to the entire size of the cleaning unit is reduced. In other words, the size of the cleaning unit has to be increased to ensure a required toner storage capacity.

In addition, the toner transportation from the cleaning chamber to the toner storage requires the transportation paddle and a driving mechanism for rotatably driving the transportation paddle, resulting in an increased production cost.

Further, if the accumulation level of the toner stored in the toner storage 902 exceeds the altitude of the lower end 903*a* of the separator plate 903 and the toner blocks the toner transportation port 908 as shown in FIG. 4, the aforesaid transportation paddle 907 is disabled from transporting the toner to the toner storage 902. Accordingly, the toner remains in the cleaning chamber 901, thereby causing a cleaning failure at an earlier stage.

SUMMARY OF THE INVENTION

In view of the foregoing, it is an object of the present invention to provide a compact cleaning unit which ensures an excellent cleaning performance for a long service period and can be manufactured at a reduced production cost.

In accordance with one mode of the present invention to achieve the aforesaid object, there is provided a cleaning unit for removing residual toner present on the periphery of a photoconductive drum after toner image transfer, which comprises: a cleaning housing having an opening facing opposite the photoconductive drum; a blade member disposed above the opening and abutting against the periphery of the photoconductive drum for scraping the toner and the like adhering on the periphery of the photoconductive drum; a cleaning roller for receiving toner scraped by the blade member, said cleaning roller abutting against the periphery of the photoconductive drum through the opening and thereby being adapted to rotate in association with rotation of the photoconductive drum; and a separator plate disposed in the cleaning housing with one edge thereof being retained close to the periphery of the cleaning roller for separating a cleaning chamber where the toner is scraped from the surface of the photoconductive drum into the cleaning housing and a toner storage for storing therein the scraped toner; wherein a spacing formed between said one edge of the separator plate and the periphery of the cleaning roller is adjusted to a predetermined spacing amount so that toner transportation pressure for transporting the toner to the toner storage through the spacing can be increased.

According to this mode, the toner scraped away from the surface of the photoconductive drum into the cleaning chamber by the blade member is received by the cleaning roller, and transported into the toner storage through the spacing between the edge of the separator plate and the periphery of the cleaning roller by the rotation of the cleaning roller. In this case, since there is provided the spacing of a predetermined spacing amount (preferably 1 mm to 2 mm, more preferably 1.3 mm to 1.5 mm), the toner is compressed when passing through the spacing and, hence, the toner transportation pressure for transporting the toner through the spacing can be increased. Therefore, even if the accumulation level of toner stored in the toner storage exceeds the altitude of the aforesaid one edge of the separator plate, the toner in the cleaning chamber can be smoothly transported to the toner storage by the cleaning roller.

This prevents the toner from being accumulated in the cleaning chamber to an undesirable level, thereby maintaining an excellent cleaning performance for a long service period. In addition, the cleaning roller per se serves as a transportation roller having a sufficient transportation capability. Therefore, the cleaning unit of the present invention has a compact and simple structure, and can be manufactured at a reduced production cost, compared with the case where additional transportation member is provided.

DETAILED DESCRIPTION OF THE PREFERRED EMBODIMENT

With reference to the attached drawings, the present invention will hereinafter be described in detail by way of a preferred embodiment.

Figure 2:
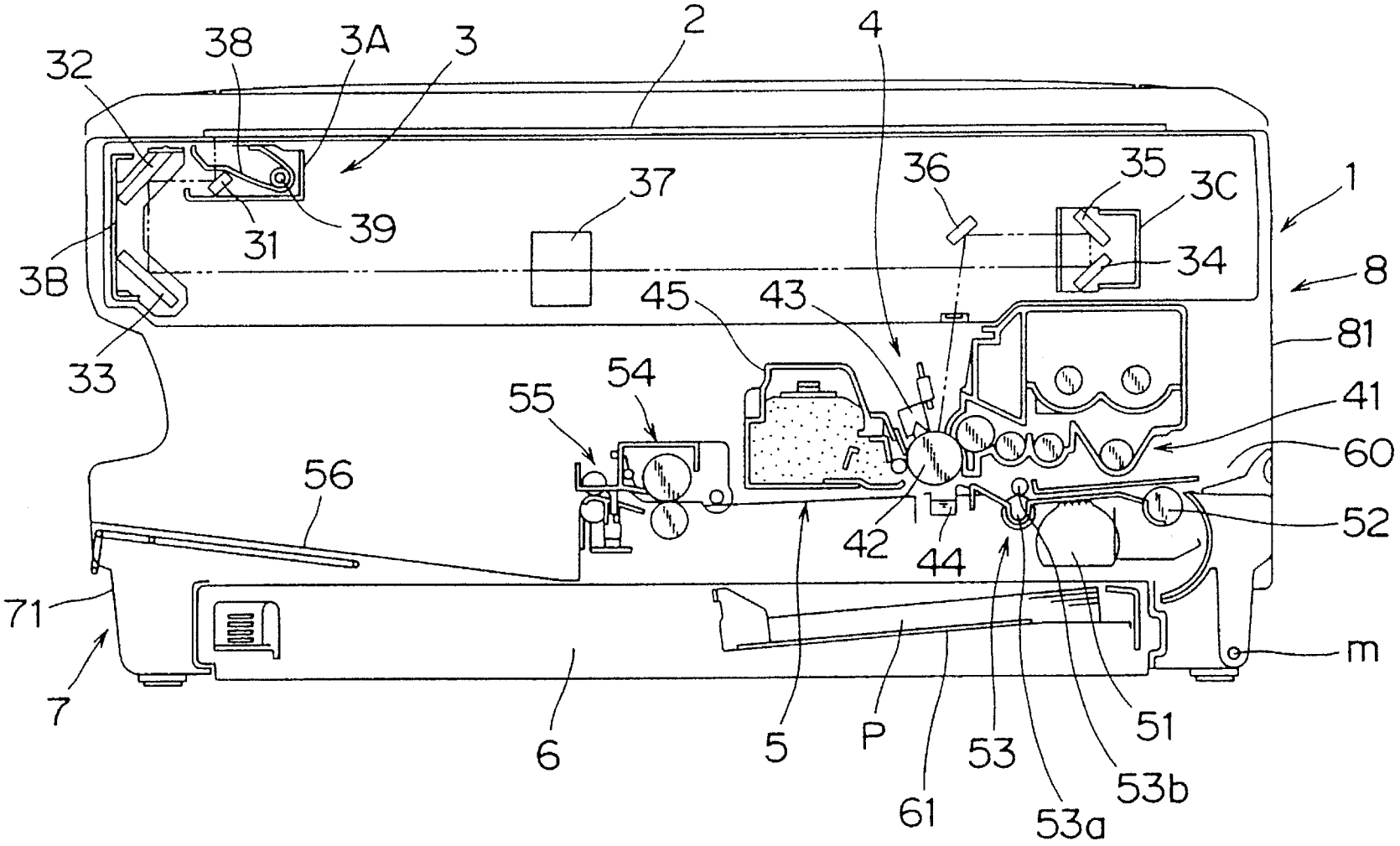
FIG. 2 is a conceptual diagram of an internal structure of a copying machine including the aforesaid cleaning unit.
Figure 3:
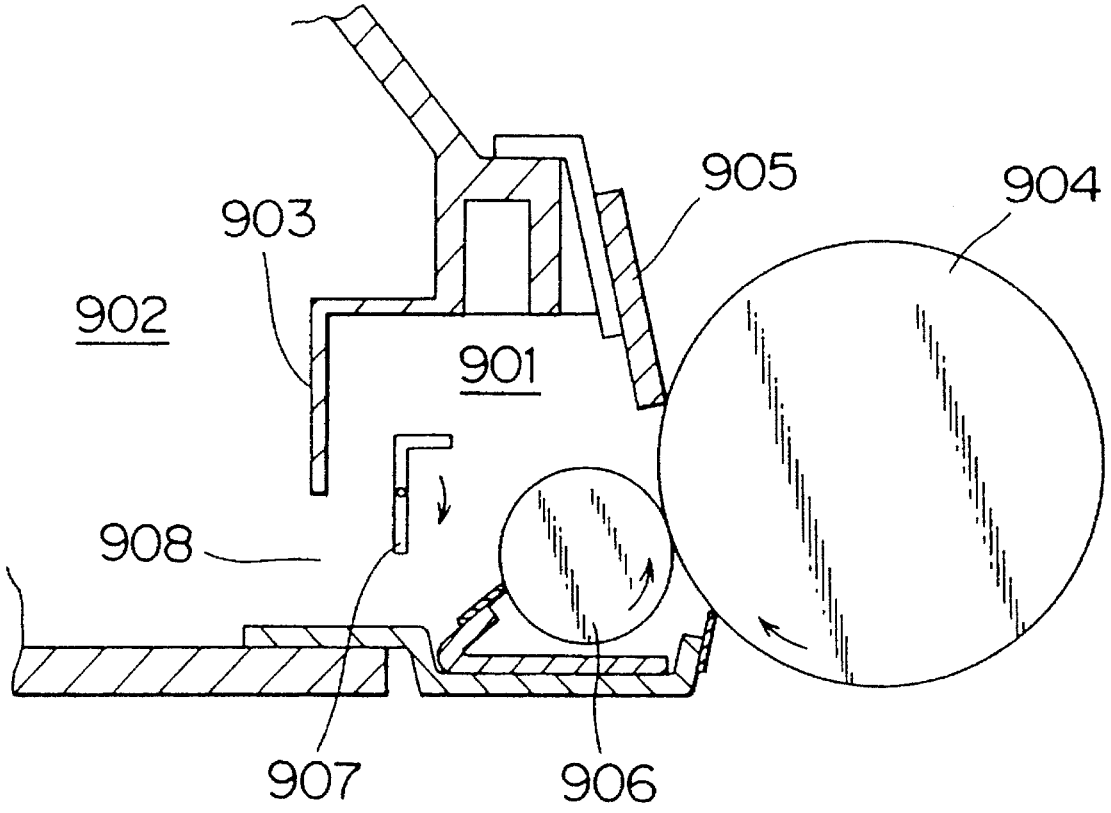
FIG. 3 is a sectional view of a conventional cleaning unit employing a cleaning roller, for a comparison thereof with the cleaning unit in accordance with the aforesaid embodiment.
Figure 4:
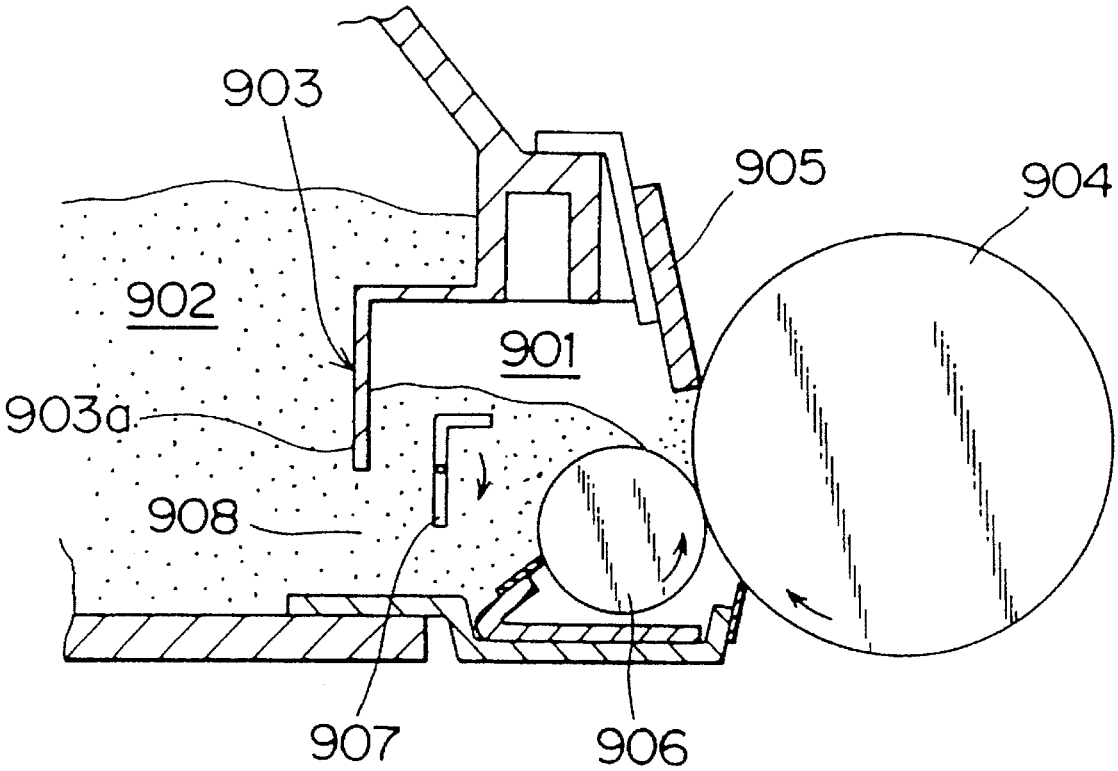
FIG. 4 is a sectional view of the conventional cleaning unit shown in FIG. 3 in a state where toner accumulated in a toner storage of the cleaning unit is increased.

A cleaning unit in accordance with one embodiment of the present invention is used, for example, in a copying machine serving as an image forming apparatus as shown in FIG. 2. Referring to FIG. 2, the copying machine includes: (1) an optical system 3 for optically scanning a document original placed on a document original placing platform 2 and leading reflected light from the document original to a photoconductive drum 42; (2) an image forming section 4 for transferring onto a paper sheet an image which has been developed by a developing unit 41 from an electrostatic latent image formed on the photoconductive drum 42; and (3) a sheet conveying portion 5 for drawing a paper sheet from a sheet feeding tray 61 in a sheet housing section 6 by means of a sheet feeding roll 51 having a semicircular cross section, then conveying the paper sheet through the image forming section 4, and discharging the paper sheet to a sheet discharging tray 56 disposed in a copying machine body 1, all of which are accommodated in the copying machine body 1.

The copying machine body 1 comprises a lower unit 7 defined by a lower casing 71 and an upper unit 8 defined by an upper casing 81. The upper unit 8 is supported for pivotal movement relative to the lower unit 7 around a predetermined pivoting axis m extending along the side portion of the upper unit 7. Accordingly, the copying machine body 1 is of a so-called clam-shell type that allows the upper unit 8 to be opened and closed with respect to the lower unit 7 by pivotal movement.

In the optical system 3, a document original is illuminated with a fluorescent lamp 39 with a reflection plate 38 fixed to a first movable frame 3A, and reflected light from the document original is led to the photoconductive drum 42 via a first mirror 31 fixed to the first movable frame 3A, second and third mirrors 32 and 33 fixed to a second movable frame 3B, a lens 37, fourth and fifth mirrors 34 and 35 fixed to a third movable frame 3C and a sixth mirror 36 in succession.

The image forming section 4 comprises a corona charger 43, developing unit 41, transfer charger 44 and cleaning unit 45, which are all arranged around the photoconductive drum 42 in the order named. In the image forming section 4, an image of the document original is formed as an electrostatic latent image on the periphery of the photoconductive drum 42 homogeneously charged by the corona charger 43, and then the electrostatic latent image is developed into a toner image by the developing unit 41. After the toner image is transferred onto a paper sheet by the transfer charger 44, residual toner on the photoconductive drum 42 is collected by the cleaning unit 45.

The sheet conveying portion 5 comprises the sheet feeding roll 51 for drawing paper sheets one by one from the sheet feeding tray 61, a sheet conveying roller 52 for conveying a paper sheet from a manual sheet feeding section 60 or sheet feeding tray 61, driving roller means **53*a* and driven roller means 53*b* which constitute a resist means 53 for abutting thereagainst the front end of the paper sheet conveyed by the sheet conveying roller 52 for temporary standby, a fixing section 54 for fixing the toner image transferred onto the paper sheet, and a pair of sheet discharging rollers 55**.

Figure 1:
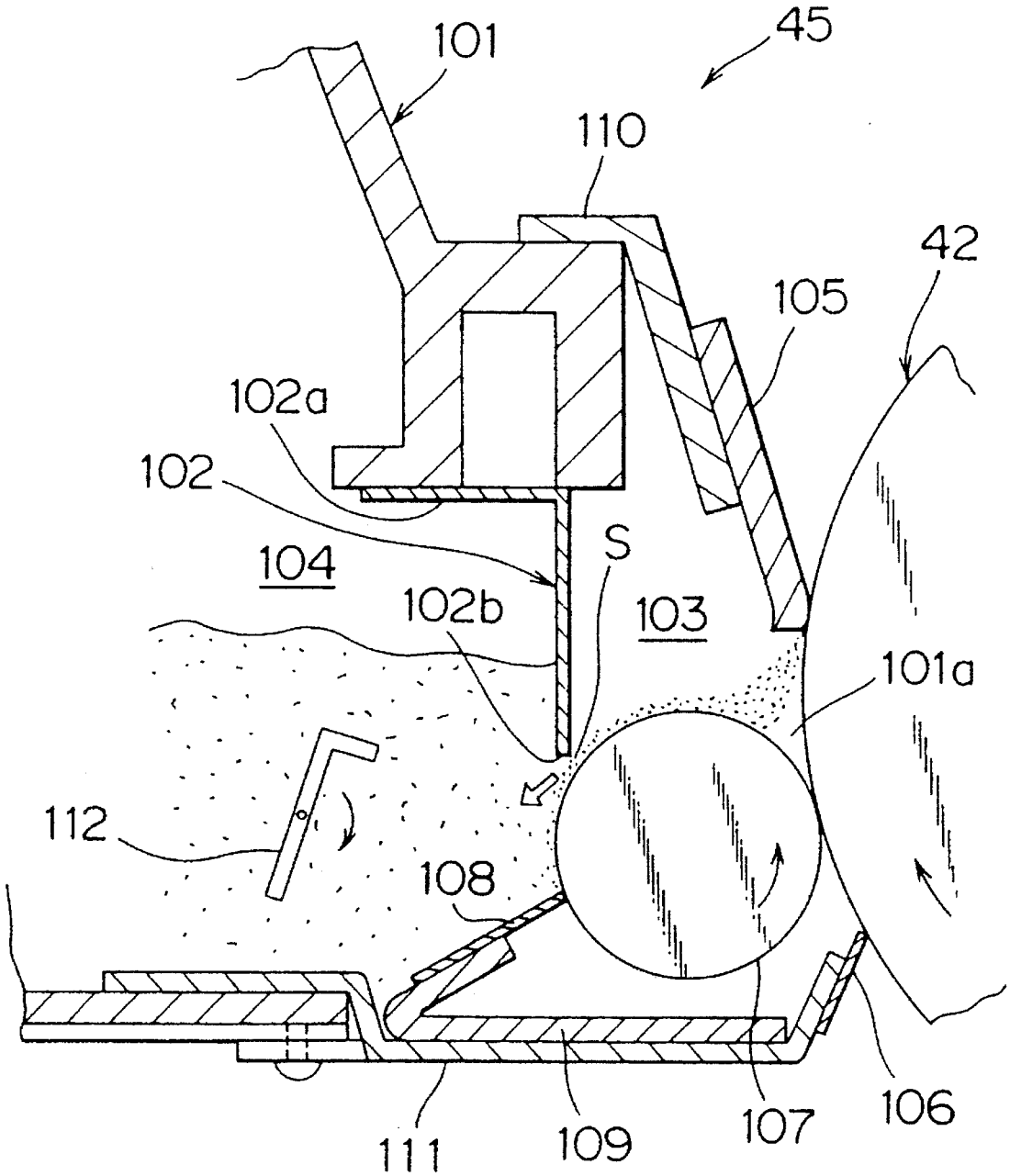
FIG. 1 is a sectional view of a cleaning unit in accordance with one embodiment of the present invention.

Referring to FIG. 1, the aforesaid cleaning unit 45 includes a cleaning housing 101 having an opening **101*a* facing opposite the photoconductive drum 42. The inner space of the cleaning housing 101 is divided into a cleaning chamber 103 where toner is scraped away from the surface of the photoconductive drum 42 and a toner storage 104 for storing therein the scraped toner by a separator plate 102** having an L-shaped cross section.

Disposed in an upper portion of the opening **101*a* is a main blade 105, the lower end of which is abutted against the periphery of the photoconductive drum 42. The main blade 105, which is fixed to the cleaning housing 101 via a fixing member 110, serves to scrape the residual toner and the like present on the surface of the photoconductive drum 42 with the lower end thereof in association with the rotation of the photoconductive drum 42. Disposed in a lower portion of the opening 101*a* is a receiving blade 106 made of rubber or the like for covering the lower portion thereof. The upper end of the receiving blade 106 is retained close to the periphery of the photoconductive drum 42 for preventing the toner and the like scraped into the cleaning housing 101 from scattering outside the cleaning housing 101**.

A cleaning roller 107 is disposed below the main blade 105 mainly in the cleaning chamber 103 with a part thereof bulging out to the toner storage 104. The cleaning roller 107, which is abutted against the periphery of the photoconductive drum 42 through the opening **101*a*, is rotatably supported by the cleaning housing 101, and is rotated in association with the rotation of the photoconductive drum 42. Since the photoconductive drum 42 is rotated clockwise as viewed in FIG. 1, the cleaning roller 107 is rotated counterclockwise. The cleaning roller 107 serves to displace on the periphery of the photoconductive drum 42 the toner and paper dust adhering thereon, so that the main blade 105 can easily scrape the toner and the like from the periphery of the photoconductive drum 42**.

The upper portion **102*a* of the separator plate 102 is fixed to the upper portion of the cleaning housing 101, and the lower end 102*b* thereof is retained close to the periphery of the cleaning roller 107. To enhance the toner transportation capacity of the cleaning roller 107, the spacing S between the lower end 102*b* of the separator plate 102 and the periphery of the cleaning roller 107** is adjusted to preferably 1 mm to 2 mm, more preferably 1.3 mm to 1.5 mm.

The upper end of a scraper 108 inclined at an angle is abutted against the periphery of the cleaning roller 107 below the position where the lower end 102*b* of the separator plate 102 is retained close to the cleaning roller 107. The scraper 108 is fixed to a fixing member 109, which is supported by a removable cover 111 constituting a part of the lower portion of the cleaning housing 101. The aforesaid receiving blade 106 is also fixed to the cover 111. The scraper 108 abutting against the cleaning roller 107 separates the cleaning chamber 103 and the toner storage 104.

Disposed in a position close to the cleaning chamber 103 within the toner storage 104 is a transportation paddle 112 having an L-shaped cross section for further transporting the toner transported from the cleaning chamber 103 to the inner part of the toner storage 104 (to the left-hand side as viewed in FIG. 1). The transportation paddle 112 is driven for clockwise rotation as viewed in FIG. 1 to transport the toner.

In this cleaning unit 45, the toner scraped by the main blade 105 in the cleaning chamber 103 falls onto the upper portion of the cleaning roller 107, and is transported through the aforesaid spacing S to the toner storage 104 and further to the upper face of the scraper 108 by the rotation of the cleaning roller 107. The toner transported onto the scraper 108 is further transported to the inner part of the toner storage 104 by the transportation paddle 112.

In accordance with this preferred embodiment, by forming a narrower spacing S between the periphery of the cleaning roller 107 and the lower end 102*b* of the separator plate 102 separating the cleaning chamber 103 and the toner storage 104, the toner transportation pressure for transporting the toner through the spacing S can be increased. Therefore, even if the accumulation level of the toner stored in the toner storage 104 exceeds the altitude of the lower end 102*b* of the separator plate 102, the cleaning roller 107 can smoothly transport the toner in the cleaning chamber 103 to the toner storage 104 through the spacing S. This prevents the toner from being accumulated in the cleaning chamber 103 to an undesirable level, thereby maintaining an excellent cleaning performance for a long service period. In addition, the cleaning roller 107 per se serves as a transportation roller having a sufficient transportation capability. Therefore, the cleaning unit of the present invention has a compact and simple structure, and can be manufactured at a reduced production cost, compared with the case where an additional transportation member is provided.

It should be understood that the present invention is not limited to the specifics of the aforesaid preferred embodiment, and various modifications may be made therein without departing from the spirit and scope of the present invention.

What is claimed is:

1. A cleaning unit for removing residual toner present on a periphery of a photoconductive drum after toner image transfer, said unit comprising:

a cleaning housing having an opening facing opposite the photoconductive drum;

a blade member disposed above said opening and abutting against the periphery of the photoconductive drum for scraping toner adhering on the periphery of the photoconductive drum;

a cleaning roller for receiving toner scraped by said blade member, said cleaning roller abutting against the periphery of the photoconductive drum through said opening and thereby rotating in association with rotation of the photoconductive drum; and a separator plate, disposed in said cleaning housing with one edge thereof being retained close to a periphery of said cleaning roller, for separating a cleaning chamber where toner is scraped from the periphery of the photoconductive drum and a toner storage for storing therein scraped toner;

wherein a spacing formed between said one edge of said separator plate and said periphery of said cleaning roller is adjusted to a predetermined spacing amount, so that toner transportation pressure for transporting toner to said toner storage through the spacing can be increase, said predetermined spacing amount being 1 mm to 2 mm.

2. A cleaning unit for removing residual toner present on a periphery of a photoconductive drum after toner image transfer, said unit comprising:

a cleaning housing having an opening facing opposite the photoconductive drum;

a blade member disposed above said opening and abutting against the periphery of the photoconductive drum for scraping toner adhering on the periphery of the photoconductive drum;

a cleaning roller for receiving toner scraped by said blade member, said cleaning roller abutting against the periphery of the photoconductive drum through said opening and thereby rotating in association with rotation of the photoconductive drum; and a separator plate, disposed in said cleaning housing with one edge thereof being retained close to a periphery of said cleaning roller, for separating a cleaning chamber where toner is scraped from the periphery of the photoconductive drum and a toner storage for storing therein scraped toner;

wherein a spacing formed between said one edge of said separator plate and said periphery of said cleaning roller is adjusted to a predetermined spacing amount, so that toner transportation pressure for transporting toner to said toner storage through the spacing can be increased, said predetermined spacing amount being 1.3 mm to 1.5 mm.

3. A cleaning unit for removing residual toner present on a periphery of a photoconductive drum after toner image transfer, said unit comprising:

a cleaning housing having an opening facing opposite the photoconductive drum;

a blade member disposed above said opening and abutting against the periphery of the photoconductive drum for scraping toner adhering on the periphery of the photoconductive drum;

a cleaning roller for receiving toner scraped by said blade member, said cleaning roller abutting against a periphery of the photoconductive drum through said opening and thereby rotating in a direction in association with rotation of the photoconductive drum; and a separator plate, disposed in said cleaning housing with one edge thereof being retained close to the periphery of said cleaning roller, for separating a cleaning chamber where toner is scraped from the periphery of the photoconductive drum and a toner storage for storing therein scraped toner;

wherein a spacing formed between said one edge of said separator plate and said periphery of said cleaning roller is adjusted to a predetermined spacing amount, so that toner transportation pressure for transporting toner to said toner storage through the spacing can be increased, and wherein said separator plate has a fixed portion fixed to said cleaning housing at a location remote from said one edge and a portion extending from said fixed portion to said one edge, said extending portion extending away from said fixed portion in a same direction as said direction of rotation of said cleaning roller, as viewed from a point proximate said spacing on a surface of said cleaning roller.

* * * * *